US007001136B2

(12) United States Patent
Perrin et al.

(10) Patent No.: US 7,001,136 B2
(45) Date of Patent: Feb. 21, 2006

(54) DEVICE FOR ATTACHING AN IMPLEMENT TO A LIFTING UNIT

(75) Inventors: Laurent Perrin, Bucey les Gy (FR); Emmanuel Berthod, Arc les Gray (FR)

(73) Assignee: Deere & Company, Moline, IL (US)

( * ) Notice: Subject to any disclaimer, the term of this patent is extended or adjusted under 35 U.S.C. 154(b) by 196 days.

(21) Appl. No.: 10/438,155

(22) Filed: May 13, 2003

(65) Prior Publication Data

US 2004/0228716 A1 Nov. 18, 2004

(30) Foreign Application Priority Data

May 17, 2002 (DE) ..... 102 21 941

(51) Int. Cl.
*E02F 3/00* (2006.01)

(52) U.S. Cl. ..... 414/723; 37/468

(58) Field of Classification Search ..... 414/723; 37/468

See application file for complete search history.

(56) References Cited

U.S. PATENT DOCUMENTS

| | | | | |
|---|---|---|---|---|
| 3,269,570 A * | 8/1966 | Wallberg | 414/723 |
| 5,263,810 A | 11/1993 | Takekata et al. | 414/723 |
| 5,466,113 A | 11/1995 | Norberg | 414/723 |
| 5,562,397 A * | 10/1996 | Albright | 414/723 |
| 6,154,989 A | 12/2000 | Kaczmarski et al. | 37/444 |

FOREIGN PATENT DOCUMENTS

| | | |
|---|---|---|
| DE | 43 27 942 C | 1/1995 |
| EP | 1 138 833 A1 | 4/2001 |

* cited by examiner

*Primary Examiner*—Donald W. Underwood

(57) ABSTRACT

The invention pertains to a device for attaching an implement to a lifting unit, in particular, to a front-end loader, wherein the implement and the lifting unit can be connected to one another by a movable bar that can be displaced from a locking position into an unlocking position by an externally activated actuator. The actuator is coupled to the bar by a coupling device designed such that a driving connection between the actuator and the bar is only produced when the actuator is activated. This makes it possible to displace the bar manually, as well as in an actuator-operated fashion.

11 Claims, 3 Drawing Sheets

DEVICE FOR ATTACHING AN IMPLEMENT TO A LIFTING UNIT

FIELD OF THE INVENTION

The invention pertains to a device for attaching an implement to a lifting unit, in particular, to a front-end loader, wherein the implement and the lifting unit can be connected to one another by means of a movable bar that can be displaced from a locking position into an unlocking position by an externally activated actuator.

BACKGROUND OF THE INVENTION

A device for attaching an implement to a lifting unit is described in U.S. Pat. No. 5,466,113. This device has a bar that can be manually displaced between a locking position in which it holds the implement on the lifting unit and an unlocking position in which the bar releases the implement. It is proposed to displace the bar into the unlocking position by means of an electric or hydraulic actuator. A bar for attaching an implement can also be displaced by an externally activated actuator in other known lifting units.

If an actuator of this type is used for displacing the bar in a remote-controlled fashion, it is no longer possible to manually displace the bar because in this case it would also be required to manually move the actuator that is rigidly coupled to the bar.

SUMMARY OF THE INVENTION

According to the present invention, there is provided an improved device for attaching an implement to the lifting arms of a front-end loader.

An object of the invention is to provide an attaching device for releasably coupling an implement to a lifting unit wherein the attaching can be operated manually, as well as by an actuator.

A more specific object of the invention is to provide an attaching device including a latching bar wherein a coupling device is located between the actuator and the bar, whereby the coupling device only produces a driving connection between the actuator and the bar when the actuator is activated, i.e., when the actuator displaces the bar from the locking position into the unlocking position. This means that the actuator is able to displace the bar into the unlocking position because the coupling device produces a driving connection in this case. A driving connection between the actuator and the bar is not produced, however, when the actuator is not activated. This means that an operator can manually displace the bar into the unlocking position.

Due to these measures, the bar can be displaced manually, for example, by means of a corresponding handle, as well as with the aid of an actuator. For example, the bar can be manually displaced if defects occur in the power supply system of the actuator. The lifting unit can be used on agricultural tractors equipped with devices for controlling the actuator, as well as on agricultural tractors that are not provided with such devices.

Preferably, the actuator can be remote-controlled from the work station of an operator. For this purpose, corresponding lines may be provided for remote-controlling and/or acting upon the actuator, for example, electrically, pneumatically or hydraulically. It would also be conceivable to realize a wireless remote control.

It is practical to utilize a spring for automatically returning the bar to the locking position after the implement is attached.

As explained above, the coupling device arranged between the actuator and the bar has the function of transmitting a movement of the activated actuator onto the bar while allowing unobstructed manual displacement of the bar when the actuator is deactivated. In this respect, it is practical to rigidly connect one element to the bar, with another element being rigidly connected to the actuator. When the actuator is activated, the element coupled to it comes into contact with the element coupled to the bar, and displaces this element into the unlocking position together with the bar. However, the element coupled to the bar can be displaced independently of the element coupled to the actuator while the actuator is deactivated.

In one preferred embodiment, the coupling device consists of a disk that is rigidly connected to and coaxially arranged on a section of the bar, and a sleeve that is rigidly coupled to the actuator and is also arranged coaxially with reference to this section of the bar, but in a displaceable fashion. This means that the actuator is able to press the sleeve against the disk in order to displace the bar from the locking position into the unlocking position. However, a number of other embodiments can also be realized. For example, it would be conceivable to utilize a fork-type element instead of a sleeve. It would also be possible to arrange the element connected to the actuator within a slot coupled to the bar, e.g., an oblong hole or a recess in the bar.

When the bar is manually actuated, it is sensible to arrest the bar in the unlocking position in order to allow the positioning of the implement on the lifting unit, without the bar interfering with this procedure. A longitudinal slot as is known, for example, from DE 42 27 942 C can be used for this purpose. The longitudinal slot has a section of smaller slot width and a section of greater slot width. The bar can be moved relative to the longitudinal slot. A stop on the bar has a dimension that is greater than the smaller slot width, but smaller than the greater slot width. When the bar is pulled from the locking position into the unlocking position transverse to the longitudinal direction of the slot, the stop is displaced out of the longitudinal slot and can be moved, in particular, turned along the longitudinal slot manually and/or under the influence of a second spring. After the bar is released, the stop comes into contact with the section of the longitudinal slot that has the smaller dimensions; the stop is arrested in the unlocking position in this section of the slot. After attaching an implement, the stop can be returned to the section of the longitudinal slot that has the greater slot width, either manually or by moving the lifting unit such that the bar contacts another element. In the section of the longitudinal slot that has the greater slot width, the bar is displaced into the locked position by the spring.

During an actuator-driven displacement of the bar, the range of motion is preferably chosen such that the implement can be detached from the lifting unit, but the stop is not moved out of the longitudinal slot. This means that the stop cannot be arrested in the unlocking position by the second spring. When the actuator is deactivated, the bar can be returned into the locking position by the first spring, namely without having to release the bar from the unlocking position either manually or by actuating the lifting unit.

In another embodiment, the range of motion of the actuator corresponds to the manual displacement such that the second spring arrests the bar in the unlocking position. The bar can subsequently be returned to the locking position either manually or by moving the lifting unit. The actuator is preferably set to its inactive position by means of a spring that, for example, is arranged within its housing. This provides the advantage that the piston is not exposed to water and dirt over extended periods of time. In addition, the spring that displaces the bar back to the locking position is not required to also move the actuator. Consequently, this spring can be realized in a more compact and inexpensive fashion.

BRIEF DESCRIPTION OF THE DRAWINGS

One embodiment of the invention is illustrated in the figures and is described in greater detail below.

DESCRIPTION OF THE PREFERRED EMBODIMENT

Figure 1:
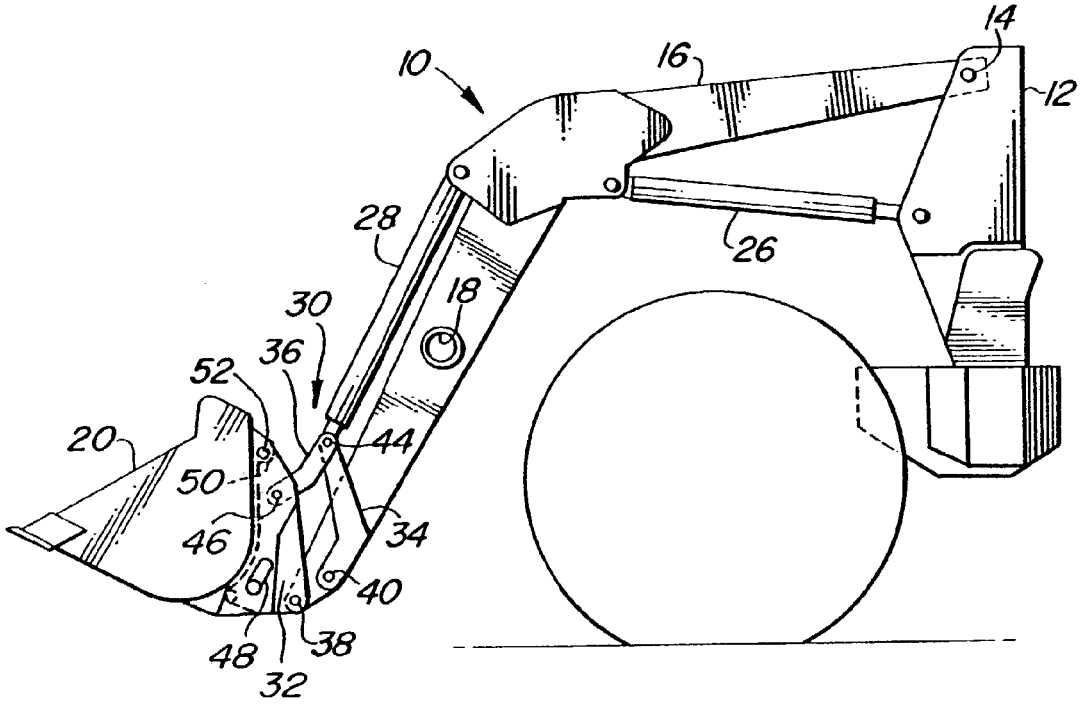
FIG. 1, a schematic, left side elevational view of a lifting unit with an implement.

Referring now to FIG. 1, there is shown a lifting unit 10 connected to the front side of a agricultural tractor, of which only a front wheel and portion of the frame is shown. The lifting unit 10 includes a mast 12 that supports a lifting boom 16 in a bearing 14. Due to its double-armed design, the lifting boom is reinforced with a crossbeam 18. An implement 20, here shown as a bucket, but which could be, e.g., a shovel, a manure fork, a bale fork or a pallet fork, is movably and interchangably connected to the front end of the lifting boom 16 by means of a control mechanism 30, described below, and an implement holder 32. The implement 20 is raised by pivoting the lifting boom 16 about the bearing 14 with the aid of hydraulic actuators 26. The inclination of the implement 20 is adjusted with another hydraulic actuator 28 that is connected to the control mechanism 30 at one end and to the lifting boom 16 at the other end. The control mechanism 30 acts upon the implement holder 32, to which the implement 20 is directly connected, and is essentially composed of first and second pivoted arms 34 and 36, respectively, that are connected to one another in an articulated fashion, wherein the hydraulic actuator 28 engages the articulation point 44. The implement holder 32 is supported in a pivoted fashion in a bearing 38 on the lifting boom 16, and the first pivoted arm 34 is supported in a bearing 40 on the lifting boom. The second pivoted arm 36 is connected in a pivoted fashion to the implement holder 32 in a bearing 46. The reference symbol 48 identifies a bar that is described in greater detail below. A hook 50 and a pin 52 for engaging the implement 20 with the lifting unit 10 are provided in the upper section of the implement holder 32.

Figure 2:
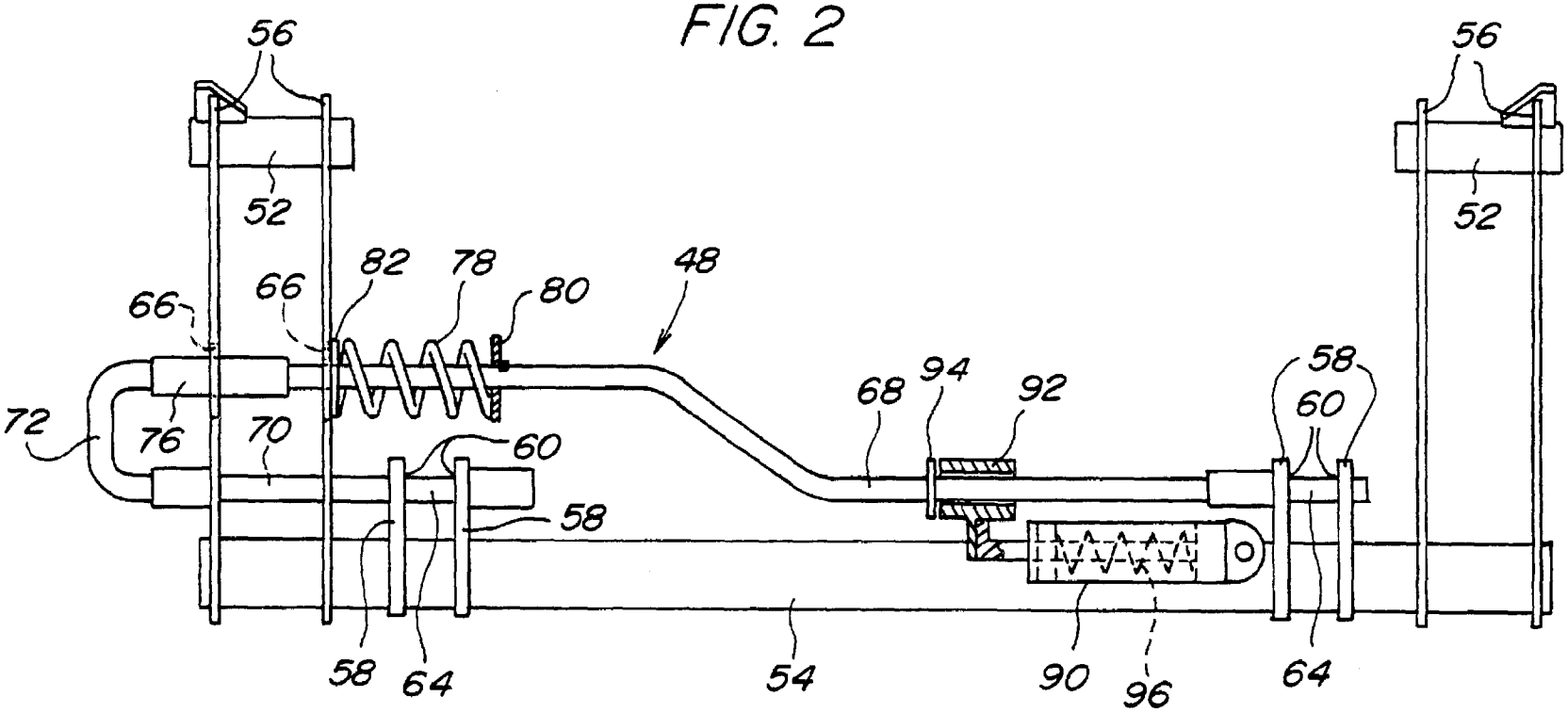
FIG. 2, a front view of a device for attaching the implement to the lifting unit.

According to FIG. 2, the underside of the implement holder 32 is composed of a cross member 54 that extends over the entire width and respective double walls 56. The end sections of the cross member 54 extend through these double walls and are welded to them.

On each side, two brackets 58 with openings 60 that are aligned with one another, project radially and parallel to one another from the side of the cross member 54 that faces the implement 20. The openings 60 serve to accommodate pin-like locking elements 64 forming respective end regions of the bar 48 and serve to connect the implement 20 to the implement holder 32 and consequently to the lifting unit 10. Brackets (not shown) with openings of this type are also arranged on the side of the implement 20 that faces the implement holder 32, wherein said openings can be aligned with one another such that the locking elements 64 of the bar 48 can be inserted into them.

Figure 3:
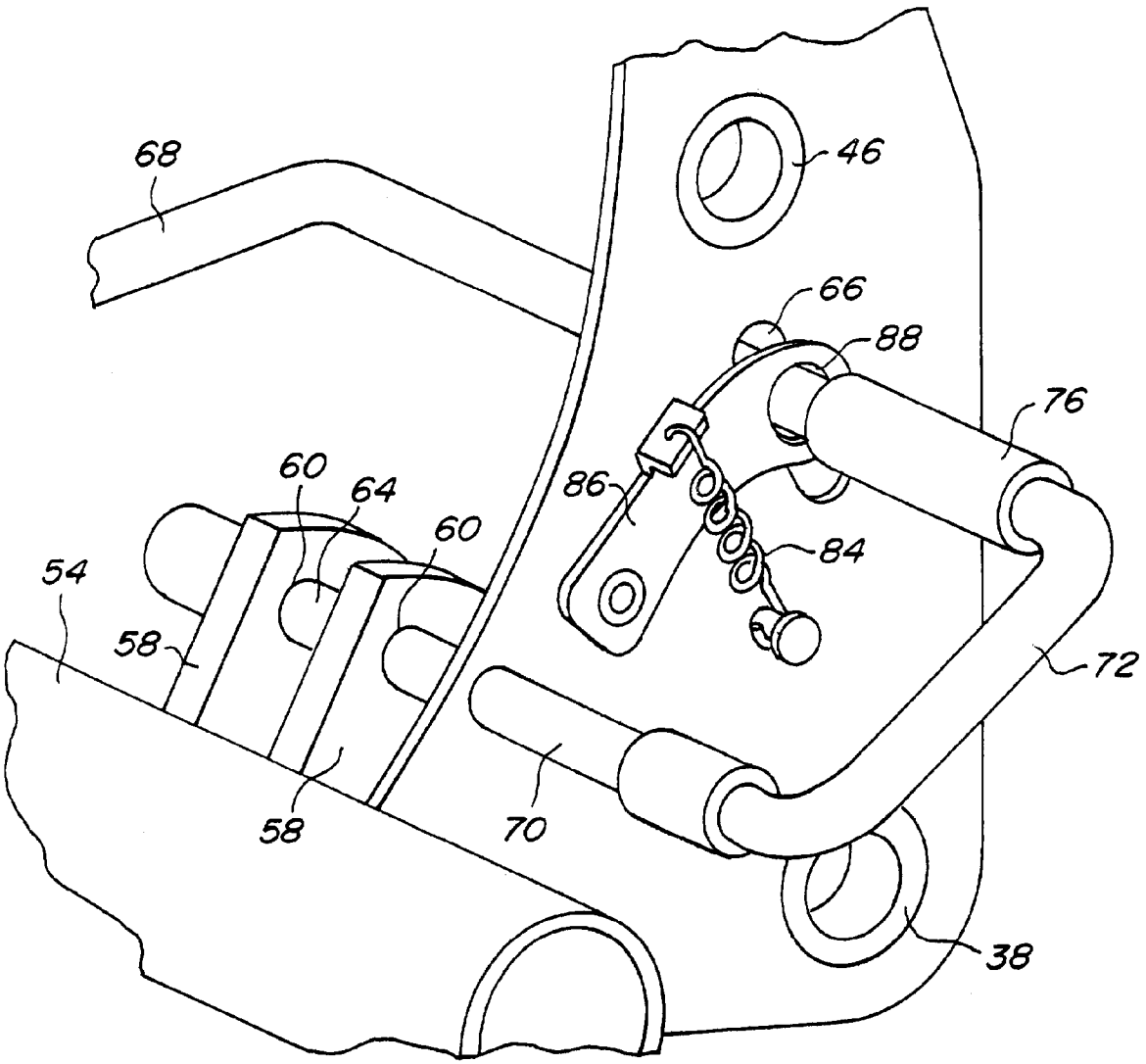
FIG. 3, an oblique side view of the left portion of the device shown in FIG. 2.

The double walls 56 of each side support the pins 52 for receiving the hooks 50 in their upper corner region, with the bearing 46 being arranged underneath and offset toward the rear, and wherein the bearing 38, for producing the connection with the lifting boom 16, is arranged in the right lower corner region (see FIG. 3). In addition, two aligned longitudinal slots 66 are respectively arranged in the walls 56 situated on the left in FIG. 2, wherein the center lines of these longitudinal slots lie on a circular arc about the center of the openings 60. The longitudinal slot 66 of the left inner wall 56 in FIG. 2 has an approximately constant slot width over its entire length. The longitudinal slot 66 of the left outer wall 56 in FIG. 2 has a narrow slot width in a lower section and a wide slot width in an upper section.

The bar 48 that is manufactured from round steel essentially has the shape of a "J" with a first, long limb 68, a second, short limb 70, and a handle 72 formed by the crosspiece connecting the two limbs.

Between the handle 72 and an end part that serves as the right locking element 64, the first, long limb 68 is bent twice in opposite directions by approximately 30°, and always guided in the openings 60 of the inner bracket 58 on the right side by means of the locking element 64. The section of the long limb 68, that is situated opposite to and radially offset relative to the locking element 64, extends through both longitudinal slots 66 and has a stop 76 that is realized in the form of a sleeve. In the locking position of the bar 48 that is shown in FIG. 2, one half of this sleeve is situated to the left of the outer wall 56 and the other half is situated to the right of this outer wall. The length of the section of the stop 76 that lies in the space between the two walls 56 essentially corresponds to the adjustment range of the bar 48 for locking and unlocking the implement 20. The outside diameter of this stop 76 is smaller than the greater slot width, but greater than the smaller slot width of the outer longitudinal slot 66. A spring 78 concentrically surrounds the long limb 68 on the inner side, i.e., to the right of the left inner wall 56 in FIG. 2. The spring 78 is compressed, with a certain pretension, between a disk 80 that is slidably received on the long limb 68 and abuts a stop located on the long limb 68, and a disk 82 that is slidably received on the long limb 68 and abuts the wall 56. In this case, the diameter of the disk 82 is greater than the width of the longitudinal slot 66 in its widest section.

The handle 72 is respectively bent twice by 90° to point in opposite directions and extends outward from the outer wall 56 into a region that is easily accessible for an operator.

The second, short limb 70 extends parallel to the section of the long limb 68 that lies before the first bend, namely through the openings 60 on the left side and corresponding bores 74 in the left walls 56, which if so required, are surrounded by guides. The second, short limb 70 also includes the end section that serves as one of the locking elements 64 and is always guided in the openings 60 in the left bracket 58.

The spring 78 is realized in the form of a helical compression spring and is arranged and tensioned in such a way that it always presses the bar 48 toward the right in FIG. 2. This means that its locking elements 64 extend through all brackets 58.

In addition, an actuator 90 in the form of an externally activated hydraulic cylinder is provided. The housing of this actuator, which extends in the longitudinal direction of the cross member 54, is mounted on the cross member 54. The piston of the actuator 90 is connected to a sleeve 92 that surrounds the long limb 68 of the bar 48 in the vicinity of the bracket 58 shown on the right in FIG. 2. The sleeve 92 is arranged near a disk 94 that is rigidly connected to the long limb 68. The piston of the actuator 90 is designed to displace the sleeve 92 toward the left from the idle position shown in FIG. 2. This makes it possible to displace the bar 48 into an unlocking position in a remote-controlled fashion.

FIG. 2 shows clearly that the bar 48 can be taken hold of at the handle 72 and pulled toward the left against the force of the spring 78. This causes both locking elements 64 to be pulled out of the second brackets 58, such that the free space between both straps of each bracket 58 becomes accessible in order to receive or detach the implement bracket. This means that the bar 48 needs to be pulled outward, i.e., toward the left in FIG. 2, in order to unlock or release the implement 20. This can also take place manually. During this process, the sleeve 92 slides along the long limb 68 of the bar 48 and the piston of the actuator 90 remains stationary.

In FIG. 3, the left outer wall 56 is not shown so as to provide a better overview. According to this figure, a second spring 84 cooperates with the bar 48. One end of the spring 84 is attached to the left inner wall 56, with its other end being mounted on a pivoted arm 86 that is coupled to the inner wall 56 such that it can be pivoted about an axis of rotation that extends parallel to the cross member 54. The long limb 68 of the bar 48 extends through an opening 88 in the pivoted arm 86. According to FIG. 3, in this way the spring 84 pulls the long limb 68 downward as soon as the stop 76 is pulled out of the longitudinal slot 66. This causes the long limb 68 to be displaced into the section of the longitudinal slot 66 that has a reduced width. The bar 48 is arrested in its unlocking position and does not have to be held when it is actuated manually.

When preparing the implement holder 32 to receive an implement 20, the bar 48 can, as described above, be manually pulled outward into the unlocking position in which it is, according to FIG. 3, turned by the second spring 84 in the clockwise direction about the axis extending through the openings 60 such that the stop 76 is displaced on the outer side to the section with reduced width of the longitudinal slot 66 in the left outer wall 56.

The spring 78 is now pre-tensioned and the bar 48 is held in the disengaged position. The implement 20 can then be attached by means of the pin(s) 52 and the hook(s) 50 and raised such that the bracket on the side of the implement is moved between the brackets 58 on the cross member 54 and all openings 60 are aligned with one another. The implement 20 is ultimately tilted toward the lifting boom 16 by means of the hydraulic actuator 28 such that the stop 76 contacts the lifting boom 16 and is pivoted into the section of the greater slot width. Once it has reached this position, the bar 48 with the two locking elements 64, is according to FIG. 2, pushed toward the right under the influence of the spring 78 such that the two locking elements 64 penetrate into all brackets and thus secure the implement 20 in position.

The implement 20 can also be unlocked or released from the work station of an operator on the agricultural tractor by activating the actuator 90 via a corresponding line such that its piston displaces the sleeve 92. The sleeve comes into contact with the disk 94 and displaces the disk 94 toward the left together with the entire bar 48. The locking elements 64 release the brackets of the implement. Since the stroke of the actuator 90 does not suffice to pull the stop 76 out of the longitudinal slot 66 in the outer wall 56, the bar 48 is not arrested in its unlocking position. The actuator 90 can be moved into its inactive position, and the spring 78 subsequently displaces the locking elements 64 between the brackets 58. If an implement 20 needs to be attached, the actuator 90 is reactivated, or remains activated, with the brackets of the implement 20 being positioned between the brackets 58 and the actuator 90 then deactivated. The spring 78 then presses the locking elements 64 between the brackets 58. The implement 20 is now locked in position. In another embodiment, the range of motion of the actuator 90 corresponds to the manual displacement. The bar 48 is in this case arrested in the unlocking position as described above and then released again.

The coupling device, consisting of the sleeve 92 and disk 94, is arranged between the actuator 90 and the bar 48 and makes it possible to actuate the bar 48 with the aid of the actuator 90, as well as independently of it, in a manual fashion. The spring 78 not only makes it possible to implement the previously described coupling device, but also makes it possible to use the actuator 90, which is in the form of a simple hydraulic cylinder.

Having described the preferred embodiment, it will become apparent that various modifications can be made without departing from the scope of the invention as defined in the accompanying claims.

What is claimed is:

1. In a combination including an implement releasably coupled to an implement holder carried at a forward end of a lifting unit of a front-end loader, and a releasable coupling device associated with said implement holder including a transversely extending, J-shaped bar movable between locking and unlocking positions for respectively securing said implement to, and releasing said implement from, said implement holder, the improvement comprising: an extensible and retractable actuator having one end coupled to said implement holder; a coupling device connected between a second end of said actuator and said bar so as to establish a driving connection between said actuator and said bar only when said actuator is activated for establishing an unlocked condition in said bar.

2. The combination, as defined in claim 1, wherein said bar has a handle which may be grasped and pulled for manually displacing the bar between said locking and unlocking positions.

3. The combination, as defined in claim 1, wherein said implement can be unlocked by an operator from a work station of the operator on a vehicle attached to said implement by activating the actuator via a corresponding line.

4. The combination, as defined in claim 1, and further including a spring coupled between said implement holder and said bar for biasing said bar toward, and for resisting movement from, said locking position.

5. The combination, as defined in claim 1, wherein said coupling device establishes a one-way connection between said bar and said actuator, whereby said coupling device displaces said bar only when the actuator is activated.

6. The combination, as defined in claim 5, wherein said coupling device includes a disk arranged concentrically to said rod and being prevented from moving along said rod in a direction said rod is moved when going from said locking to said unlocking position; and said coupling device further including a sleeve fixed to said second end of said actuator and mounted for sliding along said rod.

7. The combination, as defined in claim 1, and further including an arresting arrangement for selectively retaining said bar in said unlocking position.

8. The combination, as defined in claim 7, wherein first and second end regions of said bar are axially aligned such that said bar may be pivoted about a horizontal transverse pivot axis; said implement holder having a wall containing an elongate opening formed arcuately about said axis; said bar having a section disposed parallel to said axis and received in said opening; said elongate opening having a portion which is of a smaller width than a remainder thereof; and said section of said bar including a stop having a dimension greater than said smaller width of said slot and which is disposed free of said slot only when said bar is moved to said unlocking position, whereby said bar may be rotated about said axis when in said unlocking position to an arrested position wherein said stop prevents said bar from moving to its locking position.

9. The combination, as defined in claim 8, and further including a spring coupled between said holder and said section of said bar and loaded so as to bias said bar towards said smaller width of said slot so as to maintain said bar in said arrested position once it is moved to said unlocking position.

10. The combination, as defined in claim 9, wherein said actuator is dimensioned such that it has a range of motion large enough for displacing the bar into a position in which the implement can be detached from the lifting unit, but not so large that the bar may be rotated into said arrested position.

11. The combination, as defined in claim 9, wherein said actuator is dimensioned such that it has a range of motion large enough that the bar is automatically arrested in the unlocking position, and by the fact that after the bar is arrested, the actuator may be relaxed from the unlocking position; and a second spring being coupled between said holder and said rod such that after said bar is arrested and said actuator is relaxed, said second spring will act to move said actuator into an inactive position.

* * * * *